United States Patent [19]

Rosen

[11] 4,209,276

[45] Jun. 24, 1980

[54] VEHICLE PARKING APPARATUS

[75] Inventor: Arnold M. Rosen, 4 Horizon Rd., Fort Lee, N.J. 07024

[73] Assignee: Arnold M. Rosen, Bergenfield, N.J.

[21] Appl. No.: 912,742

[22] Filed: Jun. 5, 1978

[51] Int. Cl.[2] ..... B66F 7/04

[52] U.S. Cl. ..... 414/240; 414/249; 187/8.59

[58] Field of Search ..... 414/227, 229, 233, 239, 414/240, 242, 249, 250; 187/8.59

[56] References Cited

U.S. PATENT DOCUMENTS

| | | | |
|---|---|---|---|
| 1,619,360 | 3/1927 | Miller | 414/239 |
| 2,702,606 | 2/1955 | Young | 414/249 X |
| 2,857,985 | 10/1958 | Simmons, Sr. | 414/249 X |
| 3,387,722 | 6/1968 | Fisher, Sr. et al. | 414/249 X |
| 3,706,356 | 12/1972 | Herbst et al. | 187/8.59 |
| 3,750,899 | 8/1973 | Greer | 414/240 |

*Primary Examiner*—Stephen G. Kunin
*Assistant Examiner*—Terrance L. Siemens
*Attorney, Agent, or Firm*—Anthony J. Casella

[57] ABSTRACT

In an apparatus for parking vehicles in vertically arranged pairs, there is provided a base frame including two spaced stanchions. Each stanchion includes a generally vertically extending portion secured to the base frame at the lower end thereof, and with the upper end of the stanchion being inclined at an acute angle of approximately 12° to the vertical. Each stanchion incorporates an elongated guide for slidably receiving a slide associated with a platform that is dimensioned to receive a vehicle, and which is elevated between a generally horizontal, lowered position to a slightly inclined elevated position by a hydraulic actuator in order to elevate the platform to enable a second vehicle to be parked beneath the platform. In the elevated position of the platform, the vehicle is prevented from rolling off the platform by engagement of one set of tires with a chock disposed on the platform, and by virtue of the inclination of the platform. The specific configuration of the stanchion insures that the elevated platform is disposed at the proper angle for preventing the vehicle from rolling off the elevated platform.

13 Claims, 4 Drawing Figures

VEHICLE PARKING APPARATUS

The present invention relates to an apparatus for parking automobiles and other vehicles in vertically arranged pairs.

With the increase in the number of vehicles used in major cities, and the scarcity of parking space, there is a great need for new and improved apparatus for parking vehicles one above the other, either in high ceiling garages, or in open air spaces. Heretofore, various expedients have been devised for taking advantage of this opportunity, but generally it has been found that the available equipment is costly and complicated, both in its use and service, such that it is economically unattractive. In addition, it has also been found that the prior art equipment has certain inherent unsafe features. As an example, in one prior apparatus, the movable platform is mounted for movement along two vertical stanchions whereby a horizontal disposition of the platform is maintained both in the lowered and in the elevated positions. Accordingly, although one set of chocks may be fixed to one end of the platform for engagement with one set of wheels of the vehicle, usually resort is made to a removable set of chocks for engaging the other set of wheels of the vehicle to prevent the vehicle from inadvertently rolling off of the platform in the elevated position. The use of removable chocks has obvious limitations, both in the sense of safety, as well as convenience of operation of the parking apparatus.

Another shortcoming of a prior art device is that the hydraulic lines interconnecting the hydraulic cylinders for raising and lowering of the platform usually extend above the top of the apparatus for interconnecting the hydraulic cylinders disposed on opposite sides of the platform. As a result, the vertical height of a vehicle that may be accommodated on the apparatus is limited by the height of the horizontally extending hydraulic lines above the elevated platform. In addition to the height limitation, the provision of hydraulic lines extending above the apparatus is a potential danger from the standpoint of possible inadvertent severing of such hydraulic lines should a vehicle of unauthorized height be elevated on the platform, as well as the obvious problems associated with maintaining and repairing any defects in the hydraulic system.

Still another shortcoming of the prior art vehicle parking apparatus is the provision of separate and distinct units wherein each unit includes two vertical stanchions, and a platform, and thus when a plurality of units are employed, a significant amount of space is taken up by abutting stanchions of adjacent units.

It is an object of the subject invention to overcome the shortcomings of the prior art apparatus for parking vehicles, and to provide a new and improved vehicle parking apparatus which is inherently safe, may be readily maintained, and provides increased capacity for parking vehicles.

It is still a further object of the subject invention to provide a new and improved vehicle parking apparatus wherein the stanchions are of new and unique design so as to inherently result in the elevated platform being disposed at an acute angle for preventing the inadvertent rolling of the vehicle off the platform.

It is still a further object of the subject invention to provide a new and improved vehicle parking apparatus wherein the hydraulic lines interconnecting the hydraulic cylinders for elevating the platform are disposed in a position so as not to limit the vertical height of vehicles which may be accommodated by the apparatus, and which are positioned to facilitate maintenance and repair, and which are protected against inadvertent severing or tampering.

It is another object of the subject invention to provide a vehicle parking apparatus wherein the stanchions are of new and unique design such that a single stanchion is capable of being operatively associated with two contiguous platforms, whereby a plurality of apparatuses may be employed in a line for increasing the overall capacity of the parking lot for accommodating vehicles.

The above objects are achieved by a new and improved vehicle parking apparatus basically including a base frame having two elongated, spaced stanchions. Each stanchion has a generally vertically extending portion secured to the base at its lower end, while the upper end of the stanchion has an angled upper portion, generally on the order of approximately 12°. Each stanchion includes elongated guide means for accommodating slide means associated with that platform that is dimensioned to receive a vehicle. The platform is mounted for generally vertical reciprocal sliding movement between the opposed stanchions by means of suitable rollers, and hydraulic elevating means are provided for raising the platform from its initial, generally horizontal position, to an elevated position such that a second vehicle can be parked beneath the elevated platform. In the elevated position, the platform is inclined with respect to the horizontal by virtue of the angled upper portion of the stanchions. The vehicle is prevented from inadvertently rolling off the platform by virtue of chocks formed as an integral portion of the platform and engaging one set of wheels of the vehicle, while the incline of the platform prevents the vehicle from rolling off in the opposite direction. By virtue of the inclined disposition of the platform, no removable chock means are required for maintaining the vehicle on the platform in the elevated position, and thus loading and unloading of the vehicle onto the platform is greatly simplified.

The vehicle parking apparatus according to the subject invention also includes the provision of means in the base frame for accommodating the hydraulic lines extending beween the reversible elevating means for actuating the platform, and thus there is no height limitation to the size vehicle that may be accommodated on the platform. In addition, since the hydraulic lines extend along the base frame of the subject apparatus, maintenance and repair of the hydraulic lines is greatly facilitated. Each vertical stanchion is preferably of H-shaped configuration, whereby two sets of rollers or guide means may be accommodated by a single stanchion. Thus, a single stanchion may function as the stanchion for two adjacent vehicle parking apparatuses, thereby greatly reducing the amount of lateral space required by a plurality of contiguous vehicle parking apparatuses made according to the subject invention.

Further objects and advantages of the subject invention will become apparent from a reading of the following detailed description taken in conjunction with the drawings, in which.

Figure 1:
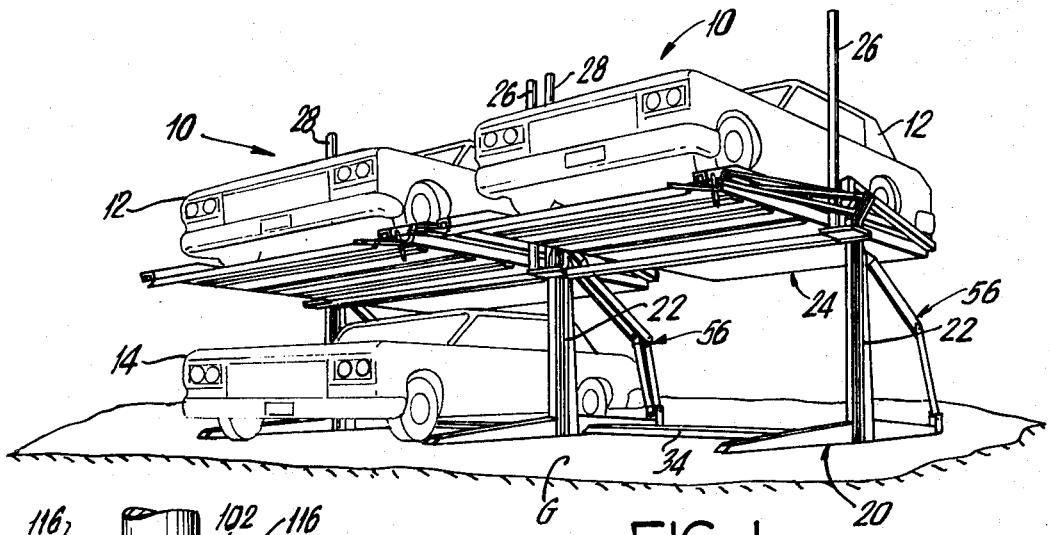
FIG. 1 is a perspective view of a plurality of vehicle parking apparatuses made according to the subject invention.

Turning to FIG. 1, the two contiguous vehicle parking apparatuses 10, 10 made according to the subject invention are illustrated in the operative position wherein a first vehicle 12 is vertically supported above a second vehicle 14. Each apparatus basically comprises a base frame 20 including upstanding stanchions 22, a platform 24 which is dimensioned to accommodate vehicle 12, and reversible elevating means 26, 28 operative to movably displace the platform from an initially lowered position on the ground G to the raised position, as shown in FIG. 1.

Figure 2:
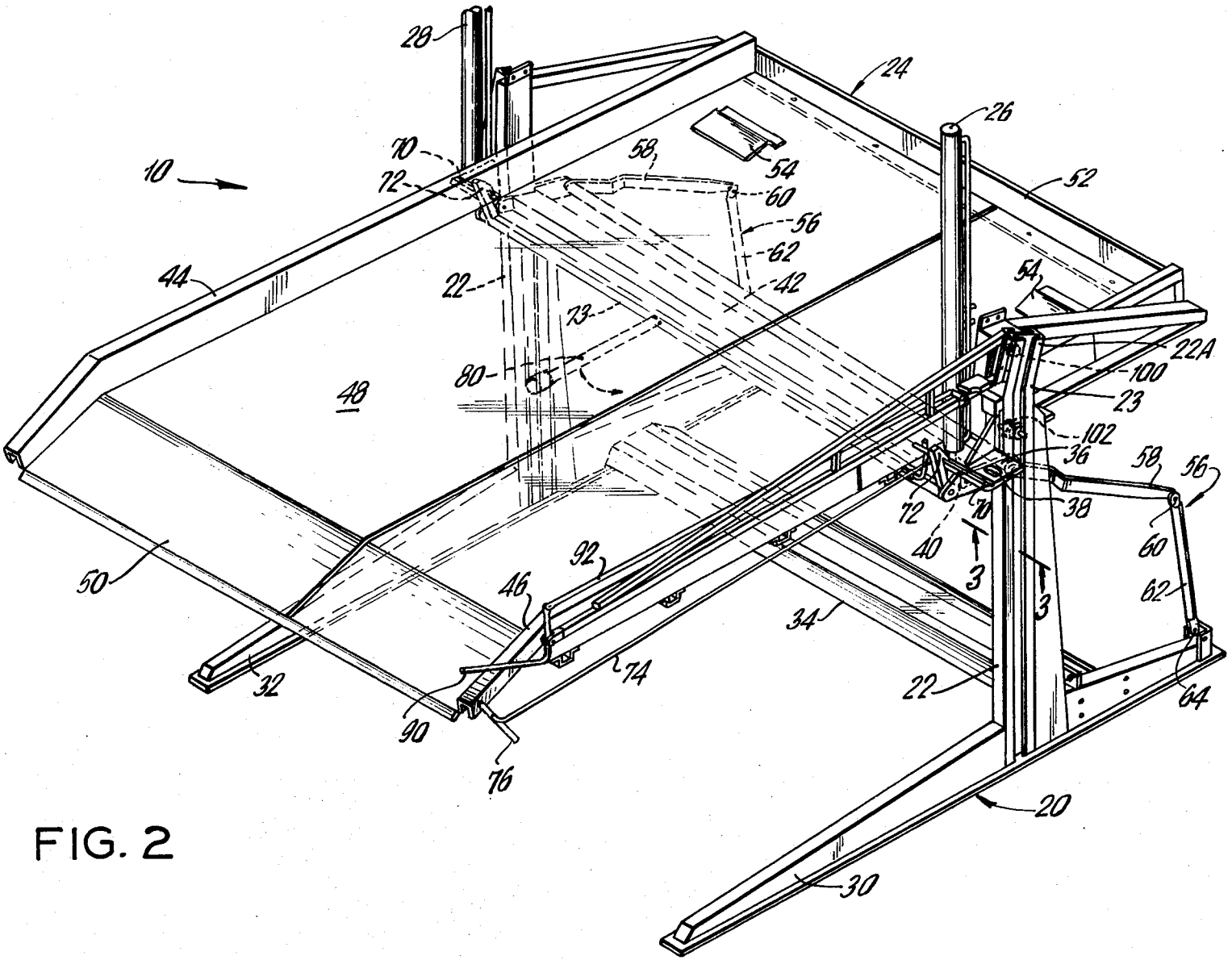
FIG. 2 is a perspective view of a vehicle parking apparatus made according to the subject invention.

The vehicle parking apparatus 10 is more clearly illustrated in FIG. 2, with the base frame 20 including two spaced legs 30, 32 that are spaced horizontally sufficient to accommodate the vehicles to be parked, and of sufficient length to brace the upstanding stanchions 22 of the apparatus. Extending between the legs 30, 32 is a lateral support member 34 which also functions to house the hydraulic lines extending to the reversible elevating means, as more fully described hereinafter. Each upstanding stanchion is rigidly secured at its lower end to the base frame and extends generally vertically to a point 23 intermediate its length. From point 23 to the free end 22A of the stanchion 22, the stanchion extends at an angle to the vertical, which angle is preferably an acute angle on the order of approximately 12°, and is designated by the letter A (see FIG. 4).

Supported on each stanchion and extending therefrom is a bearing plate 36 having openings 38 therein. The reversible elevating means 26, 28 are in the form of hydraulic cylinders, with each hydraulic cylinder being fixedly secured to a bearing plate 36, and with the piston thereof extending through an opening 38 in the bearing plate. The opposite end of the piston of each hydraulic piston is connected by a pivot block 40 to the lateral bearing bar support 42 of platform 24. Accordingly, upon retraction and extension of the piston rods of a hydraulic cylinder 26, 28, the platform 24 is respectively raised and lowered. The platform 24 is defined by side rails 44 and 46, the central plate 48 including inclined ramp 50, and a rear end wall or chock 52. In addition, front chocks 54, 54 are provided in the plate 48 whereby a pair of wheels of the vehicle 12 will be restrained between the rear chock 52 and the front chocks 54, 54. The entire platform 24 is supported by means of the lateral bearing bar 42 to which is connected a pair of stabilizer bar linkages 56, 56. Each of the latter includes a bar member 58 pivotally connected as at 60 to a tubular member 62 which, in turn, is pivotally connected as at 64 to one of the legs 30, 32 of the base frame 20. The stabilizer bar linkages 56, 56 function to insure that movement of the platform 24 between its lowered and elevated positions is uniform.

Each bearing plate 36 also includes a locking groove 70 extending along the front portion thereof, and adapted to cooperate with a safety lock hook 72 connected by a linkage 74 to an operating handle 76. The two safety lock hooks are interconnected by a linkage 73 extending beneath the platform 24. The safety lock hooks 74, 74 are spring biased to a position in engagement with the locking groove 70 when the platform 24 is in the raised or elevated position. In order to release the safety lock hooks, it is necessary to raise the platform such that the hooks 74, 74 clear the respective locking grooves in the bearing plates 36, after which the handle 76 may be actuated so as to enable the platform 24 to be lowered. At the time that the handle 76 is actuated, a safety bar 80 connected to linkage 73 interconnecting opposed hooks 74 traverses a 180° arc such that if a vehicle 14 should be beneath the elevated platform, the safety bar 80 would prevent the safety hooks 74 from disengaging from the locking grooves 70, thereby preventing lowering of the platform 24.

In order to control the operation of the hydraulic cylinders 26, 28, a manually operated lever 90 is provided and is connected via a linkage 92 to a valve control means 94 (see FIG. 4) which, via hydraulic lines 96 extend to the hydraulic supply and pump means 98.

Figure 3:
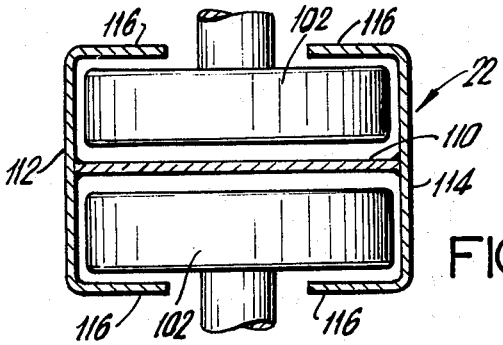
FIG. 3 is a sectional view of a stanchion taken along lines 3—3 in FIG. 2.

Secured to the structural portion of the platform are vertically spaced upper 100 and lower 102 rollers which are accommodated in the support structure forming a portion of the lateral bearing bar 42. The rollers are accommodated in elongated guide means formed in each stanchion 22. As shown in FIG. 3, each stanchion 22 is of generally H-shaped including a central web 110 and opposed end webs 112, 114. Extending from each end web are flanges 116 thereby defining two elongated slotted guides for accommodating the rollers 100, 102 extending from adjacent platforms. Accordingly, each stanchion 22 is capable of providing support for two platforms on opposite sides thereof, and thus the number of stanchions required in an arrangement of adjacent vehicle parking apparatus 10 as shown in FIG. 1, is greatly reduced, as heretofore required in prior art devices where two individual stanchions were required for each vehicle parking apparatus.

In the elevated position of platform 24, the upper rollers 100 are above the intermediate points 23 in the opposed stanchions, while the lower rollers 102 are in the vertical portions of the stanchions below point 23. Thus the platform is disposed at an angle (corresponding to the angle A) with respect to the horizontal plane. At such time the ramp 50 portion of the platform is raised relative to the chock end 52 of the platform. In this elevated position of the platform, the vehicle 12 is inclined so as to prevent inadvertent rolling of the vehicle in the direction of the ramp 50. The chocks 52, 54 prevent rolling of the vehicle in the opposite direction. Accordingly, there is no need for removable chocks, or other devices for maintaining the vehicle 12 on the platform in the elevated position.

Figure 4:
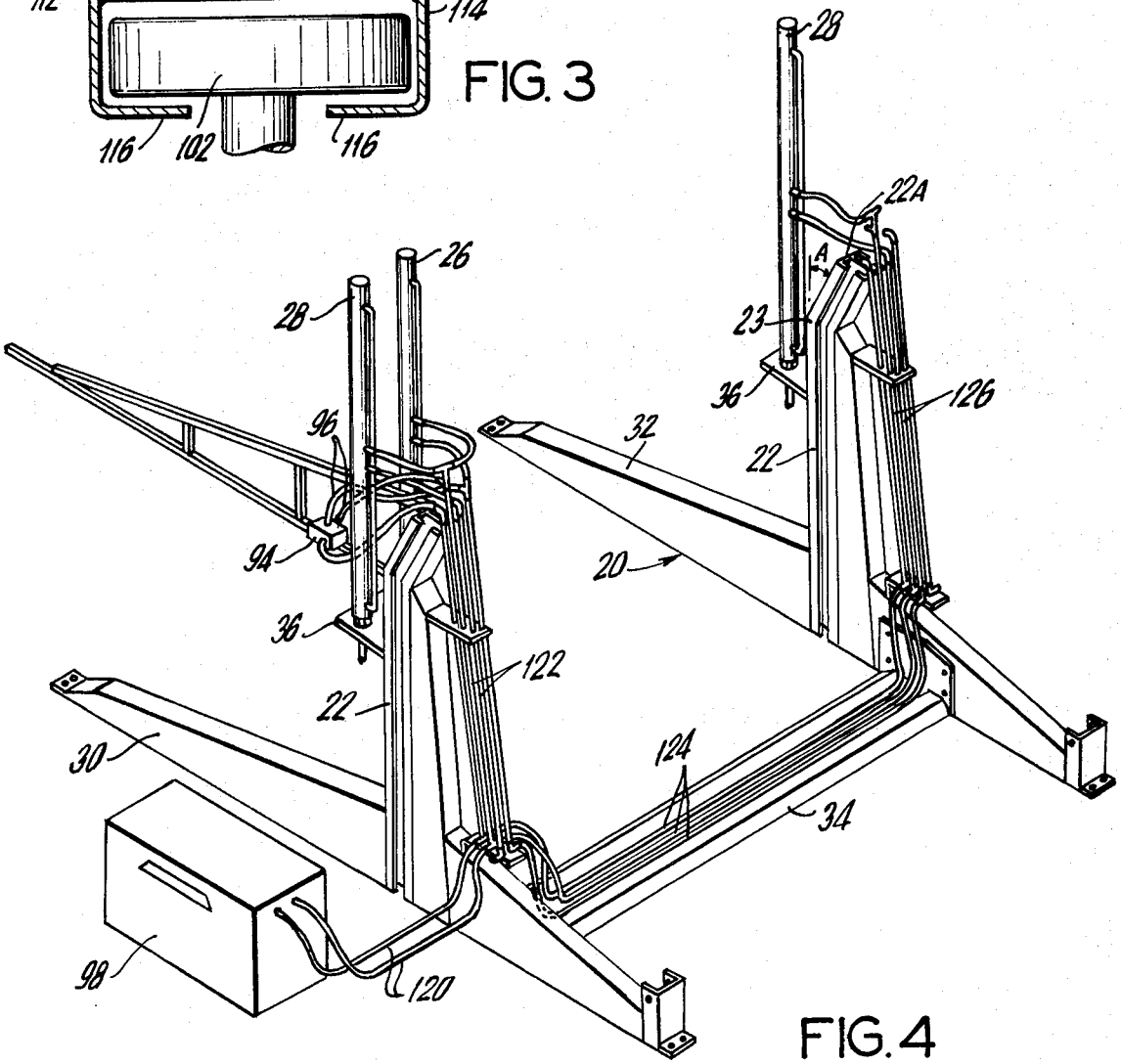
FIG. 4 is a perspective view illustrating the hydraulic system of the vehicle parking apparatus of the subject invention.

Further referring to FIG. 4, it is noted that the main fluid supply lines 120 extending from the hydraulic supply and pump means 98 are connected by suitable fittings to lines 122 extending to the first hydraulic cylinder 26, and additional fluid supply lines 124 extend to lines 126 connected to the second hydraulic cylinder 28. The fluid lines 124 are disposed within the lateral support member 34 of the base frame 20, and are suitably enclosed. Thus, the hydraulic lines 124 are protected against inadvertent severing, and in such position do not in any way hinder or limit the height of a vehicle 12 which may be accommodated in the vehicle apparatus when the platform 24 is in the elevated position, as shown in FIG. 1. Still further, maintenance of the supply line 129 is greatly facilitated by virtue of their ready accessibility.

In operation, a car 12 is driven onto the platform member 24 from the ramp 50 and with its wheels being finally positioned between the chocks 52, 54. After the car is fully loaded, the actuating handle 90 for the hydraulic control means is manually actuated such that the valve control means 94 are actuated, and hydraulic fluid is provided from the hydraulic supply and pump means 98 to the elevating hydraulic cylinders 26 and 28. The piston rod of each hydraulic cylinder is retracted, thereby elevating the platform to the elevated position wherein the safety lock hooks 74 engage the locking grooves 70 in the bearing plates 36. In such position, a dual safety is provided both in the form of the safety lock hook mechanical engagement with the bearing plate, as well as the hydraulic locking achieved within the reversible elevating means 26, 28.

In the elevated position of the platform 24, space is now afforded for driving a second vehicle 14 below the elevated first vehicle 12, utilizing the available parking area to a maximum advantage. Hence, the capacity of a restricted storage space is doubled.

For unloading of the apparatus 10, the second vehicle 14 is driven from under the platform 24, after which the hydraulic actuating handle 90 is actuated thereby further retracting the piston of each elevated means 26, 28 and thus further raising the platform 24. When the platform 24 is raised, the handle 76 is actuated and after the safety bar 80 traverses 180° and does not encounter any obstruction, the hooks 72 clear locking grooves 70. Now the platform may be lowered by reverse actuation of the valve 94. The platform 24 is then slowly lowered under the action of the metering of the hydraulic fluid within the reversible elevating means 26, 28.

When the platform reaches its lowermost position, the first vehicle 12 may be then driven off.

Accordingly, there is provided a new and improved vehicle parking apparatus including stanchions of new and unique design so as to enable the apparatus to maintain a vehicle in the elevated position without resort to removable chocks and the like. In addition, the new and improved parking apparatus is simple in construction, safe to operate, and sufficiently low in cost to be attractive economically.

Although the invention has been described with reference to a particular embodiment, it is apparent that modifications and adaptations thereof may be readily apparent to those skilled in the art, and hence the scope of the invention should be limited only by the appended claims.

What is claimed is:

1. Vehicle parking apparatus comprising:

a base frame including two elongated, spaced stanchions, each stanchion being of unitary construction and having a generally vertically extending portion rigidly secured to the base frame at the lower end thereof, and an angled upper portion, each stanchion having elongated guide means extending along the length thereof;

a platform mounted on said base frame and dimensioned to receive a vehicle, said platform including slide means on opposite sides thereof respectfully engaged with the elongated guide means of the spaced stanchions for substantially free reciprocation of said platform along the length of the stanchions, each stanchion being generally H-shaped in cross-section, and including inwardly directed flanges disposed at the free ends thereof for defining channels forming the elongated guide means for receiving said slide means, and wherein said slide means comprises upper and lower vertically spaced rollers respectfully secured to the platform and adapted to freely reciprocate in said channels; and reversible elevating means supported by said stanchions and connected to the platform for elevating the platform with a first vehicle thereon from an initial, generally horizontal position to an elevated position wherein said upper rollers are in the angled upper portions of the stanchions while the lower rollers are in the lower, vertically extending portions of the stanchions such that said platform is inclined with respect to the horizontal at an angle substantially corresponding to the angled upper portions of the stanchions, whereby a second vehicle can be parked beneath the elevated platform.

2. Vehicle parking apparatus as in claim 1 wherein said angled upper portion of each stanchion is disposed at an acute angle to the generally vertically extending portion of the stanchion.

3. Vehicle parking apparatus as in claim 2 wherein said angled upper portion is inclined at the angle approximately 12° with respect to the vertical.

4. Vehicle parking apparatus as in claim 1 wherein the reversible elevating means comprise a pair of vertically disposed fluid operated cylinders positioned one on each side of the platform, above the same, and having elongated piston rods pivotally coupled one to each side of the platform, with the fluid lines extending from said cylinders to the power supply extending along the base frame intermediate the stanchions.

5. Vehicle parking apparatus as in claim 1 further including mechanical locking means for securing the platform in its elevated position, said locking means being pivotally connected to the platform and adapted to engage cooperating portions of the spaced stanchions.

6. Vehicle parking apparatus as in claim 1 wherein said platform includes a wheel chock for capturing one set of wheels of the first vehicle.

7. Vehicle parking apparatus as in claim 1 wherein the reversible elevating means comprises:

a pair of vertically disposed, fluid operated cylinders positioned one on each side of the platform, above the same, and having elongated piston rods pivotally coupled one to each side of the platform; and an hydraulic circuit including the cylinders and containing valve means for adjusting the cylinders between platform-raising and platform-lowering positions, and lever means connected to the valve means for operating same.

8. Vehicle parking apparatus as in claim 1 wherein a second base frame, second platform, and an additional stanchion are provided, along with second reversible elevating means supported by said additional stanchion and one of said two elongated, spaced stanchions, to define two contiguous vehicle parking apparatuses utilizing the signal central stanchion.

9. Vehicle parking apparatus comprising:

a base frame including two elongated spaced stanchions, each stanchion being of unitary construction and having a generally vertically extending portion secured to the base frame at the lower end thereof, and an angled upper portion disposed at an acute angle to the generally vertical extending portion of the stanchion, each stanchion being of generally H-shaped cross-section, and including elongated guide means extending along the length thereof;

a platform mounted on said base frame and dimensioned to receive a vehicle, said platform including a wheel chock for capturing one pair of wheels of a vehicle, said platform including slide means on opposite sides thereof respectfully disposed in the elongated guide means of the spaced stanchions for substantially free reciprocation of said platform along the length of the stanchions, said slide means comprising upper and lower vertically spaced rollers respectfully secured to the platform and adapted to freely reciprocate in said guide means; and a pair of vertical disposed fluid operated cylinders respectfully supported by said stanchions and connected to the platform for elevating the platform with a first vehicle thereon from an initial, generally horizontal position to an elevated position wherein said upper rollers are disposed in the upper angled portions of the stanchions while the lower rollers are disposed in the lower, vertically extending portions of the stanchions such that said platform is inclined with respect to the horizontal at an angle corresponding to the angled upper portions of the stanchions, and wherein said vehicle is restrained from rolling in one direction by the wheel chock, and in the opposite direction by the incline of the platform, such that a second vehicle can be parked beneath the elevated platform.

10. Vehicle parking apparatus as in claim 9 wherein said angled upper portion is inclined at the angle approximately 12° with respect to the vertical.

11. Vehicle parking apparatus as in claim 9 wherein a second base frame, second platform, and an additional stanchion are provided, along with second reversible elevating means supported by said additional stanchion and one of said two elongated spaced stanchions, to define two contiguous vehicle parking apparatuses utilizing the single central stanchion.

12. Vehicle parking apparatus as in claim 9 further including mechanical locking means for securing the platform in its elevated position, said locking means being pivotally connected to the platform and adapted to engage cooperating portions of the spaced stanchions.

13. Vehicle parking apparatus as in claim 12 wherein said mechanical locking means further include a safety bar which, upon actuation of the locking means, traverses an arc of 180° below the elevated platform to ensure that a second vehicle is not disposed thereunder prior to disengagement of the locking means from the cooperating portions of the spaced stanchions.

* * * * *